United States Patent [19]

Demura et al.

[11] Patent Number: 4,995,143

[45] Date of Patent: Feb. 26, 1991

[54] DOOR OPERATING MECHANISM

[75] Inventors: Toshiaki Demura; Ikuo Tonoki, both of Osaka, Japan

[73] Assignee: NEC Home Electronics Ltd., Osaka, Japan

[21] Appl. No.: 307,761

[22] Filed: Feb. 8, 1989

[30] Foreign Application Priority Data

Mar. 16, 1988 [JP] Japan ..... 63-34828
Jul. 30, 1988 [JP] Japan ..... 63-101925

[51] Int. Cl.[5] ..... E05D 11/06

[52] U.S. Cl. ..... 16/357; 16/362; 312/323

[58] Field of Search ..... 16/357, 362; 312/323

[56] References Cited

U.S. PATENT DOCUMENTS 689,588 12/1901 Hoult ..... 312/323

1,729,401 9/1929 Richards ..... 312/323

*Primary Examiner*—Richard K. Seidel
*Assistant Examiner*—Carmine Cuda
*Attorney, Agent, or Firm*—Cushman, Darby & Cushman

[57] ABSTRACT

A door operating mechanism for opening and closing a door with respect to a vertical opening of a case includes a hinge structure for selectively connecting an upper end of the door to the case in a hinged manner so as to guide a pivotal movement of the door between a vertically closed position and a horizontally extended open position where the door is extended outwardly from the case. There is provided a guide structure for guiding the horizontal movement of the door between the horizontal extended open position and a horizontal retracted open position where the door is received in the case. Thus, the door can be suitably received in the case, so that the opened door will not be obstructive.

10 Claims, 6 Drawing Sheets

DOOR OPERATING MECHANISM

BACKGROUND OF THE INVENTION

This invention relates to a door operating mechanism for use in a cabinet such as a support case on which a television set is placed and more particularly to a door operating mechanism in which the door is pivotally moved from a vertical closed position to a horizontal open position.

In conventional doors of the hinge type used in a support case for a television set or other cabinets for storing and showing things, the hinge portion is stationary with respect to the case or cabinet body.

In the conventional door operating mechanisms, when the door is opened, the thus opened door becomes obstructive, and it detracts from the appearance. Further, there is a risk that the opened door may be damaged or broken particularly where the door is made of a panel of glass.

SUMMARY OF THE INVENTION

It is therefore an object of this invention to provide a door operating mechanism which ensures that the door in its open position will not be obstructive and eliminates the possibility of damage to the door particularly where the door is made of a glass panel.

According to the present invention, there is provided a door operating mechanism for opening and closing a door with respect to a vertically-disposed opening of a case. The mechanism has a hinge means for selectively connecting an upper end of the door to the case in a hinged manner so as to guide a pivotal movement of the door between a vertical closed position and a horizontal extended open position where the door is extended outwardly from the case and a means for guiding the horizontal movement of the door between the horizontal extended open position and a horizontal retracted open position where the door is received in the case.

With this construction, the door can be pivotally moved from its vertically closed position to horizontal extended open position, and then can be pushed from its horizontal retracted open position, so that the door is suitably received in the case. Therefore, the opened door will not be obstructive and is free from any damage due to an external force.

DETAILED DESCRIPTION OF THE PREFERRED EMBODIMENT

Figure 1:
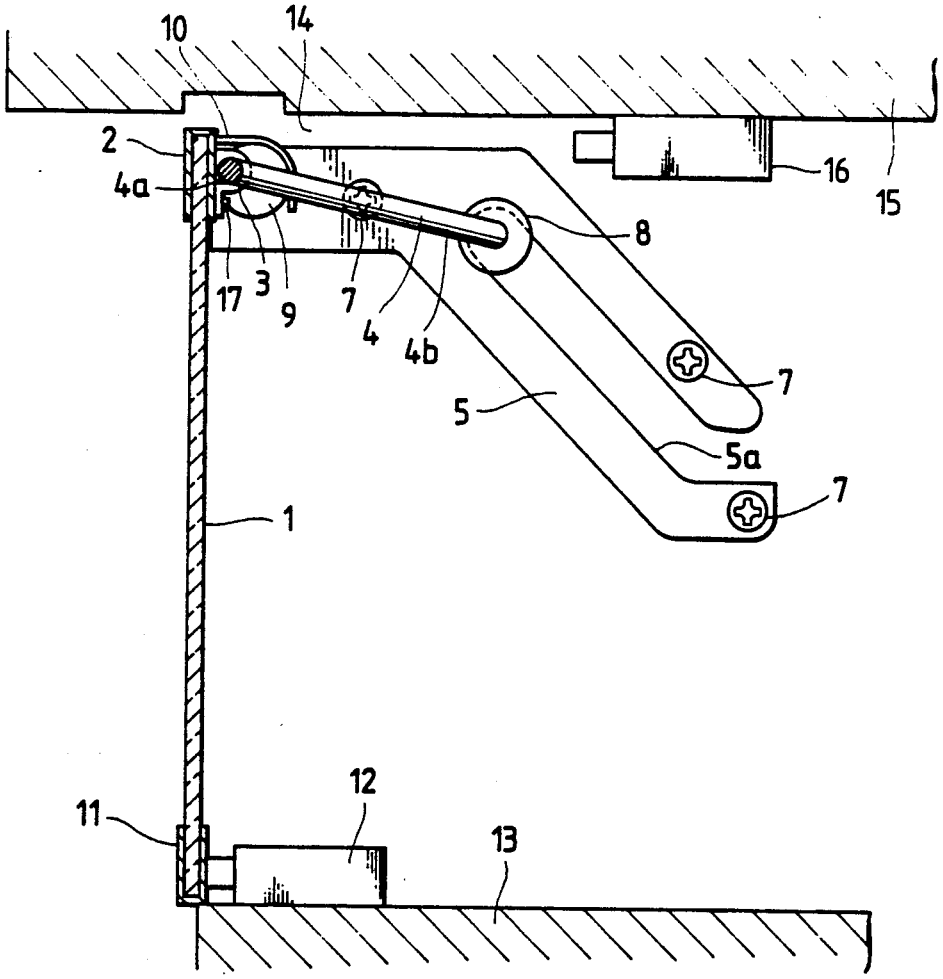
FIG. 1 is a vertical cross-sectional view of a portion of a case or cabinet incorporating a door operating mechanism according to the present invention.

A first embodiment of the invention will now be described with reference to FIGS. 1 to 8.

A door operating mechanism according to the invention is used for opening and closing a door 1 with respect to a vertically-disposed opening of the box-like body of a case or cabinet such as one on which a television set is to be placed. The door 1 is a panel made, for example, of glass. An edging member 2 of an inverted U-shaped cross-section is snugly fitted on and secured to an upper end or edge of the door 1. The edging member 2 is made of a magnetic metal. A lateral movement preventing bar 4 of a circular cross-section is mounted on the edging member 2 so as to prevent the door 1 from being displaced laterally relative to the case body. The lateral movement preventing bar 4 is crank-shaped. More specifically, the bar 4 is defined by a main straight portion **4*a*, a pair of opposed arm portions 4*b* extending right-angularly respectively from opposite ends of the main portion 4*a*, and a pair of end portions 4*c* extending right-angularly respectively from one ends of the opposed arm portions 4*b* remote from the main portion 4*a* and directed away from each other. A pair of bearings 3 are fastened to the inner side of the edging member 2 by screws 17, and the main portion 4*a* of the lateral movement prevention bar 4 are borne by the pair of bearings 3 immediately adjacent to the opposed arm portions 4*b* in such a manner that the bar 4 is angularly movable about the main portion 4*a* with respect to the bearings 3. The lateral movement preventing bar 4 is prevented by the pair of bearings 3 from being displaced with respect to the door 1 in the lateral direction of the door 1**.

Figure 2:
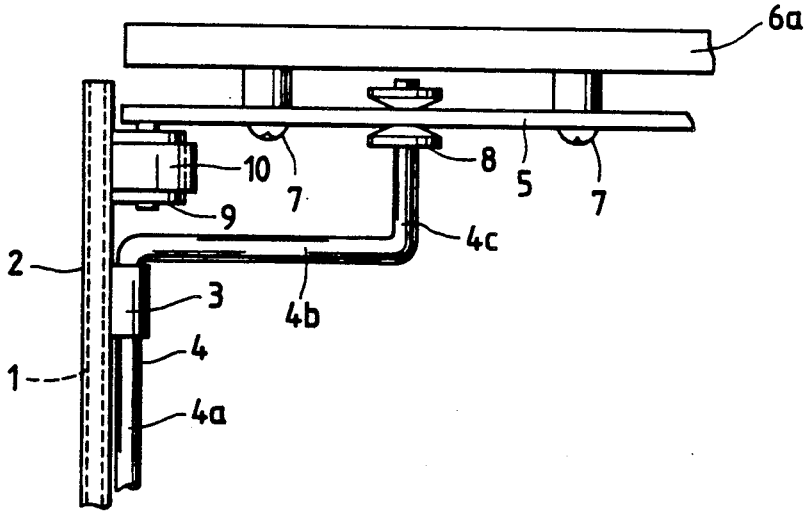
FIG. 2 is a fragmentary plan view of the door operating mechanism of the present invention.

The case body on which the door 1 is mounted has a pair of opposed side plates **6*a* and 6*b*, and a pair of guide plates 5 are fixedly secured by screws 7 to inner surfaces of the side plates 6*a* and 6*b*, respectively, as best shown in FIG. 2. A front end of each guide plate 5 is disposed adjacent to the opening of the case body. Each guide plate 5 has a slot 5*a* extending from a point intermediate the opposite ends thereof to the rear end thereof. A roller 8 having a peripheral groove is mounted on each of the end portions 4*c* of the lateral movement preventing bar 4, and the grooved roller 8 is fitted in the slot 5*a* in the guide plate 5 for movement therealong. This ensures that the bar 4 will not be displaced out of position in the lateral direction of the door 1**.

Figure 3:
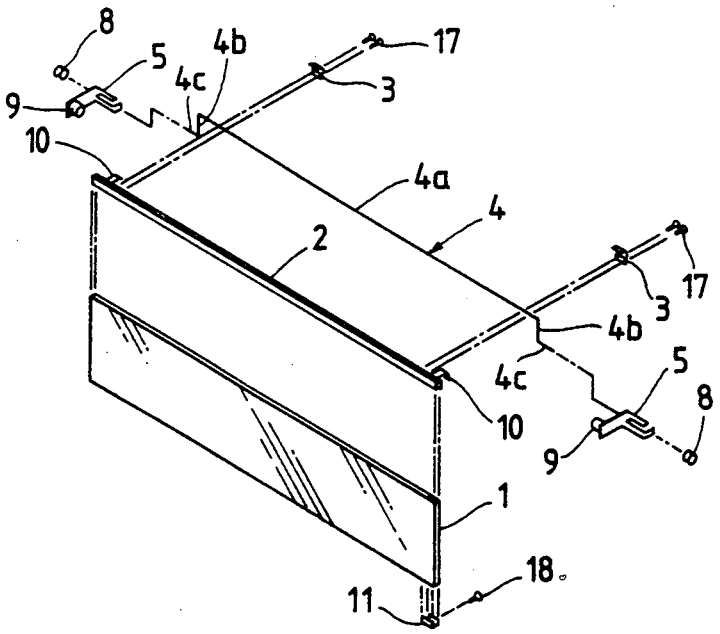
FIG. 3 is an exploded, perspective view of the door operating mechanism of the present invention.
Figure 4:
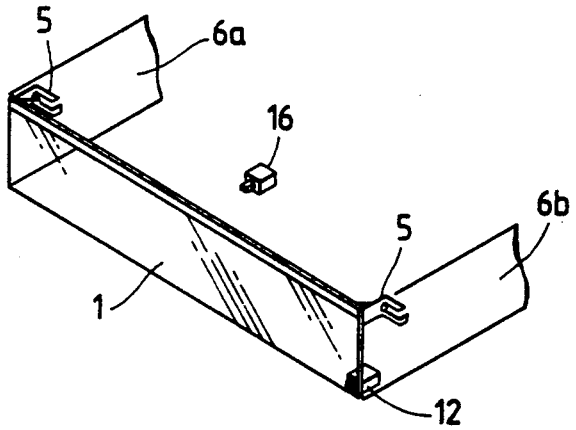
FIGS. 4 and 5 are schematic, perspective views showing the operation of the door operating mechanism of the present invention.
Figure 5:
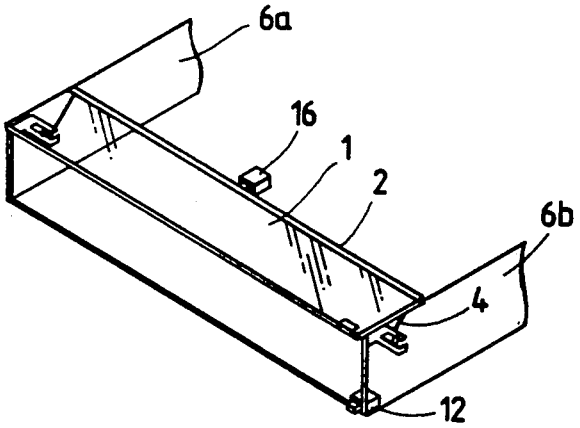

A roller 9 is rotatably mounted on the inner surface of each of the guide plates 5. A pair of hinge members 10 of a generally arcuate shape or hook-shape are fixedly mounted on the opposite ends of the edging member 2 at inner side thereof, the hinge member 10 embraces part of the outer periphery of the roller 9. The pair of rollers 9 support the door 1 through the pair of hinge members 10 in such a manner that the door 1 can be pivotally moved between its vertical closed position and horizontal extended open position, as later described. The rollers 9 also serve to effect a horizontal smooth movement of the door 1 between its horizontal extended open position and horizontal retracted open position as later described. The roller 9 and the hinge member 10 constitute a hinge means. A magnet catch piece 11 is fixedly mounted by a screw 18 as shown in FIG. 3 on the lower edge of the door 1, for example, at its right-hand side as shown in FIG. 4. A magnet catch 12 is mounted on an upper surface of a bottom plate 13 of the case body, the magnet catch 12 being mounted in opposed relation to the magnet catch piece 11 when the door 1 is in its closed position. As hereinafter more fully be described, the door 1 is adapted to be received in a space 14 which is part of the interior of the case body and which is immediately below an upper plate 15 of the case body. Another magnet catch 16 magnetically holds the edging member 4 when the door 1 is received in the case body. Magnet catch 16 is mounted on the lower surface of the upper plate 15 of the case body central of the width of the upper plate 15. The magnet catch 16 is suitably spaced rearwardly from the opening of the case body formed at its front. Each of the magnet catches 12 and 16 is of such a construction that once it is pushed, it holds the magnet catch piece 11 or the edging member 2 under a magnetic attractive force, and releases the magnet catch piece 11 or the edging member 2 when pushed.

Figure 6:
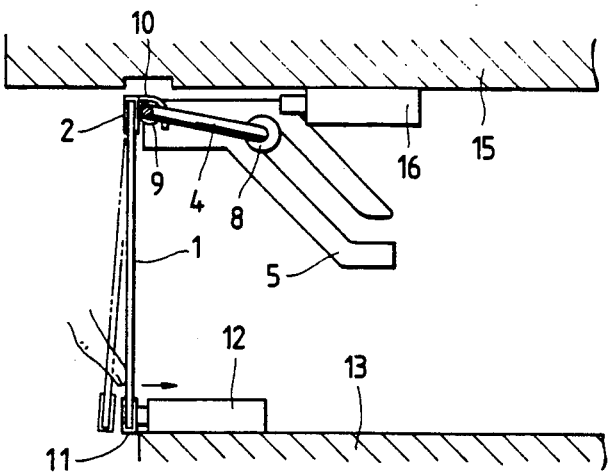
FIGS. 6 to 8 are vertical cross-sectional views of a case, showing the operation of the door operating mechanism of the present invention.
Figure 7:
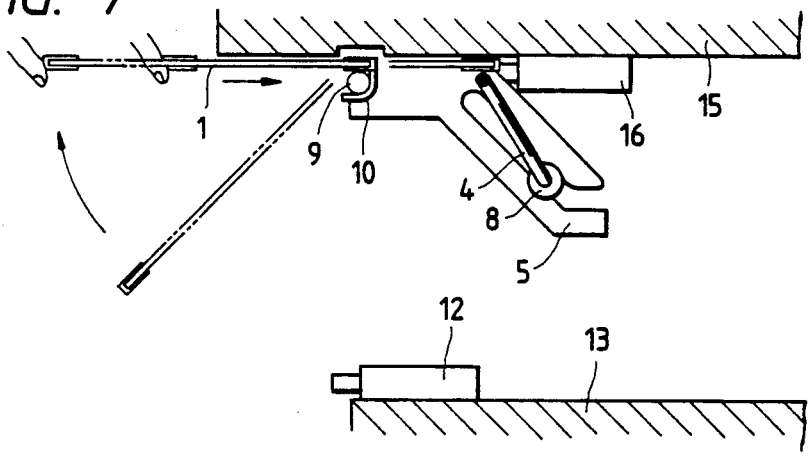

In operation, when the door 1 is in its vertical closed position as shown in FIGS. 1, 2 and where the vertically-disposed opening of the case body is closed by the door 1, the pair of hinge members 10 engage the rollers 9 respectively, to support the door 1. In this position, the magnet catch piece 11 is magnetically held by the magnetic catch 12. Then, when the door 1 is pushed by the finger as shown in FIG. 6, the magnet catch piece 1 is disengaged from the magnet catch 12 to enable the door 1 to be opened. Then, the door. 1 is manipulated to be opened, that is, pivotally moved outwardly of the case body into its horizontal extended open position (FIG. 7) where the door 1 is disposed in substantially parallel relation to the upper plate 15 of the case body, that is, in perpendicular relation to the vertically-disposed opening of the case body. In this position, the pair of hinge members 10 are angularly moved around the respective rollers 9 in such a manner that the door 1 is supported by the rollers 9 through the hinge members 10.

Figure 8:
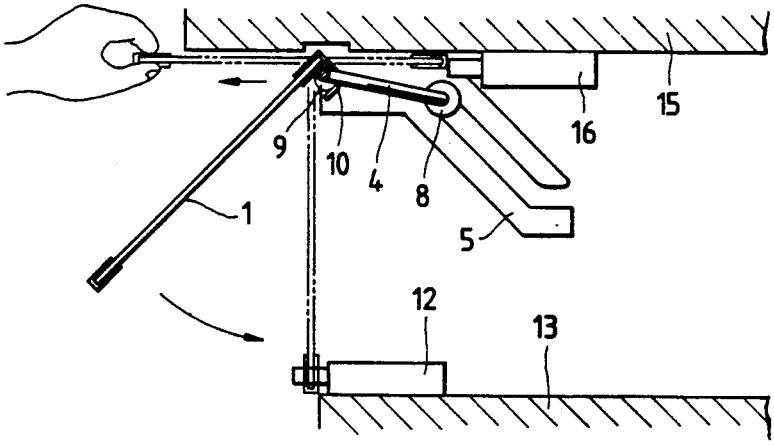

Then, the door 1 is manipulated to be horizontally pushed from its horizontal extended open position into space 14 within the case body, that is, into its horizontal retracted open position as seen from FIG. 8, so that the edging member 2 is attracted and held by the magnet catch 16. Upon movement of the door from its horizontal extended open position toward its horizontal retracted open position, each hinge member 10 is disengaged from a respective one of the rollers 9 since the hinge member 10 of a generally arcuate shape embraces part of the outer periphery of the roller 9. Thus, the hinge member 10 will not interfere with this horizontal movement. Also, during this movement, any lateral movement of preventing bar 4 is prevented since the grooved rollers 8 fitted in the respective slots 5*a* of the guide plates 5 are moved therealong. Therefore, the door 1 which is not displaced relative to the lateral movement preventing bar 4 is also prevented by the bar 4 from being displaced in the lateral direction of the door 1, so that the door can be smoothly received in the case body. And, even if the horizontally-disposed door 1 is horizontally pushed at any portion thereof for movement into its horizontal retracted open position, the door 1 will not rattle and can be smoothly introduced into the space 14 within the case body. Further, when the door 1 is horizontally moved from its horizontal extended open position to horizontal retracted open position, the pair of rollers 9 support and rollingly engage the door 1, so that this horizontal movement is effected in a smooth and stable manner.

Since the door 1 can be introduced into the case body in its open condition, the opened door is not obstructive, and the appearance of the case or cabinet will not be affected in either the open or closed position of the door 1. In addition, there is no risk that the door I may be damaged or broken even where the door is composed of a glass panel.

For closing the door 1, the door 1, received in the space 14 in its horizontal retracted open position, is pushed so as to disengage the edging member 2 from the magnet catch 16. Then, the door 1 is horizontally withdrawn by the hand from the case body to its horizontal extended open position as shown in FIG. 8, so that each of the hinge members 10 is engaged with a respective one of the rollers 9. Then, the door 1 is pivotally moved downwardly toward its vertical closed position, so that the magnet catch: piece Il is magnetically held by the magnet catch 12 to thereby close the vertically-disposed opening of the case body. The withdrawal of the door 1 to its horizontal extended open position can be carried out smoothly, as described above for the movement of the door 1 from its horizontal extended open position to its horizontal retracted open position.

The hinge means may be modified in various ways. For example, instead of providing the hinge members 10 and the rollers 9, the lateral movement preventing bar 4 may be modified such that a main straight portion 4*a* disposed in parallel relation to the door 1 is slidably fitted at each end thereof in a horizontal slot formed in each guide plate 5 so that the door 1 can be openably supported by the main portion 4*a* of the bar 4, in which case opposed end portions 4*c* and 4*c* are directed toward each other.

In the above embodiment, although the hinge means is provided at the upper portion of the case so that the door 1 is openable upwardly, it may be provided at the lower portion or the side portion of the case so that the door 1 is openable downwardly or laterally.

A second embodiment of the invention will now be described with reference to FIGS. 9 to 16. Those portions of this embodiment identical to the parts of the first embodiment mentioned above are denoted by the same reference numerals, and explanation thereof will be omitted.

Figure 9:
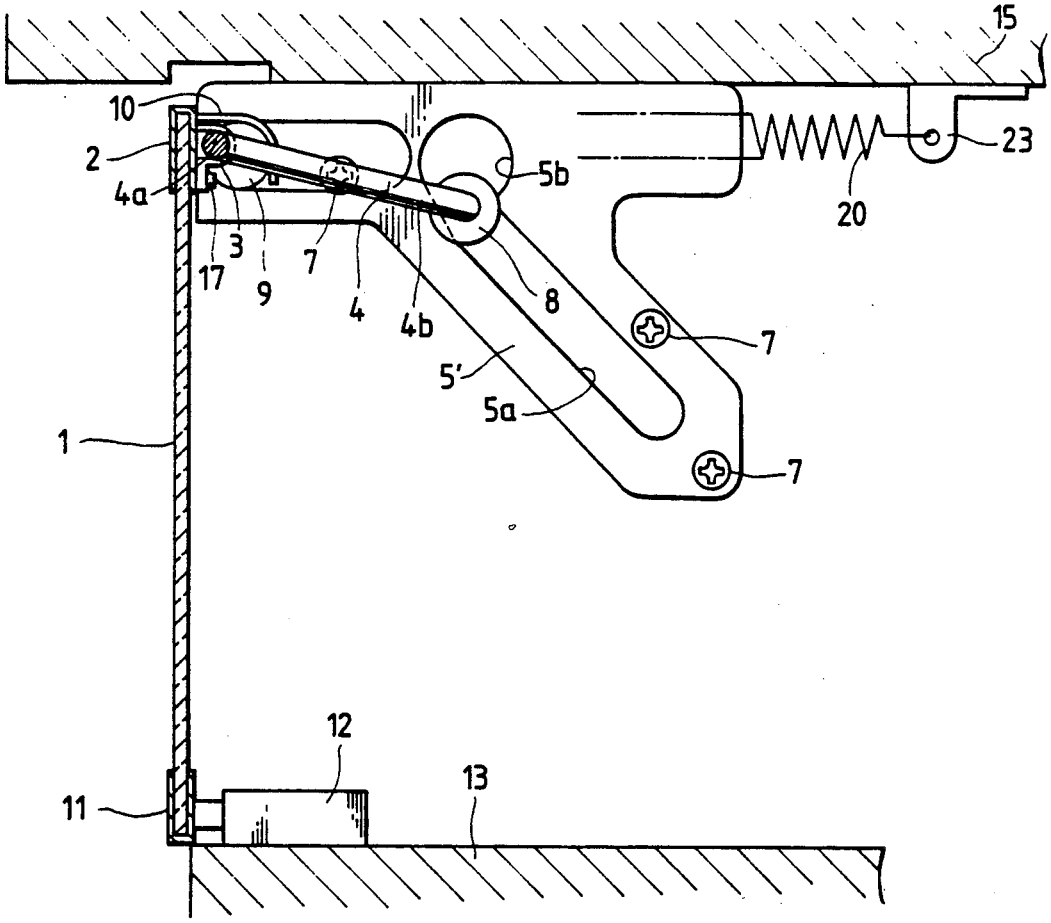
FIG. 9 is a vertical cross-sectional view showing a second embodiment of the door operating mechanism of the present invention.
Figure 10:
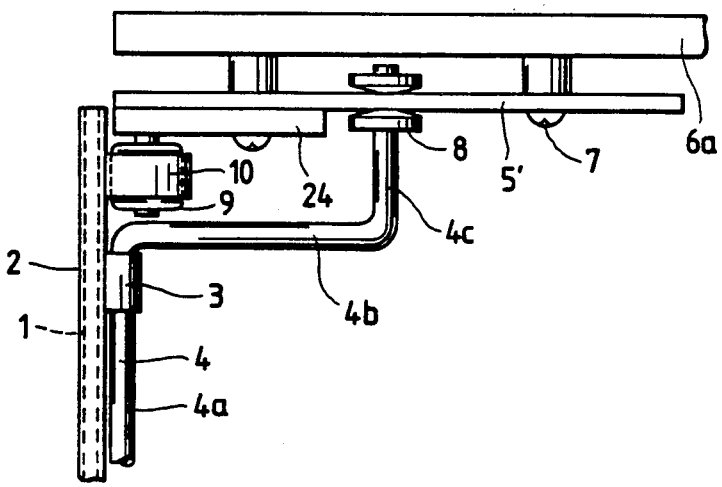
FIG. 10 is a fragmentary plan view showing the door operating mechanism of FIG. 9.
Figure 11:
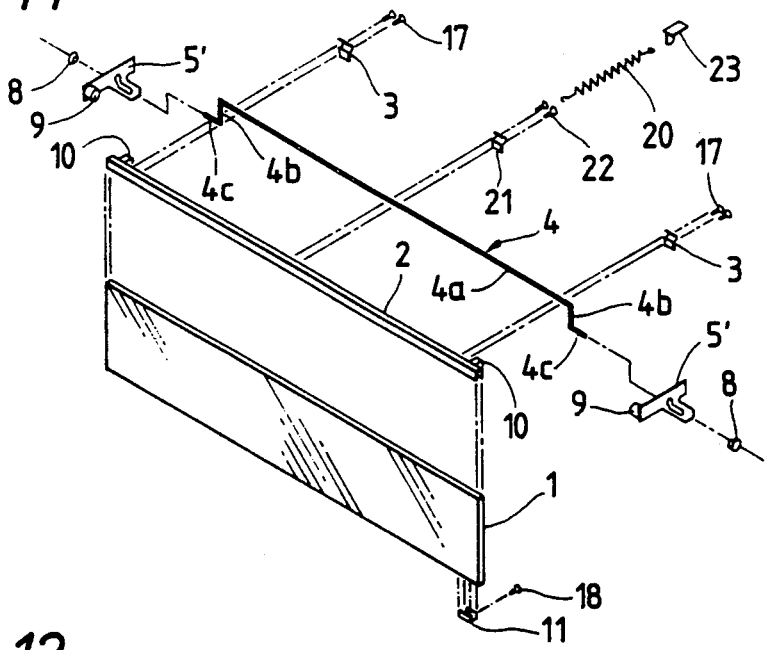
FIG. 11 an exploded perspective view showing the door operating mechanism of FIG. 9.
Figure 12:
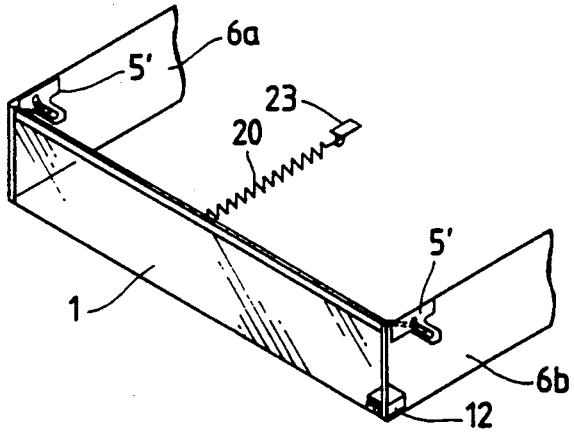
FIGS. 12 and 13 are schematic perspective views showing the operation of the door operating mechanism of FIG. 9.
Figure 13:
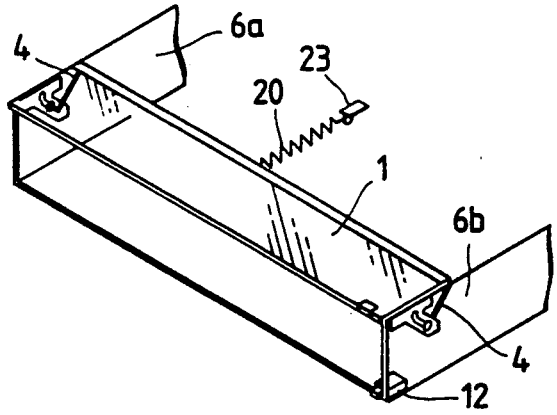
Figure 14:
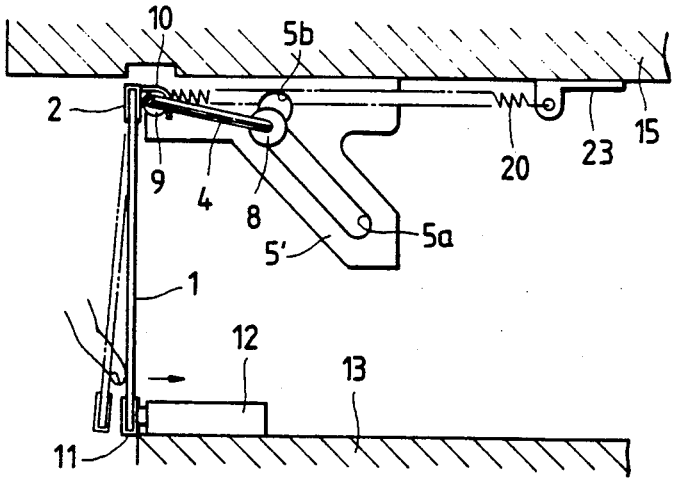
FIGS. 14 to 16 vertical cross-sectional views of a case are view showing the operation of the door operating mechanism of FIG. 9.
Figure 15:
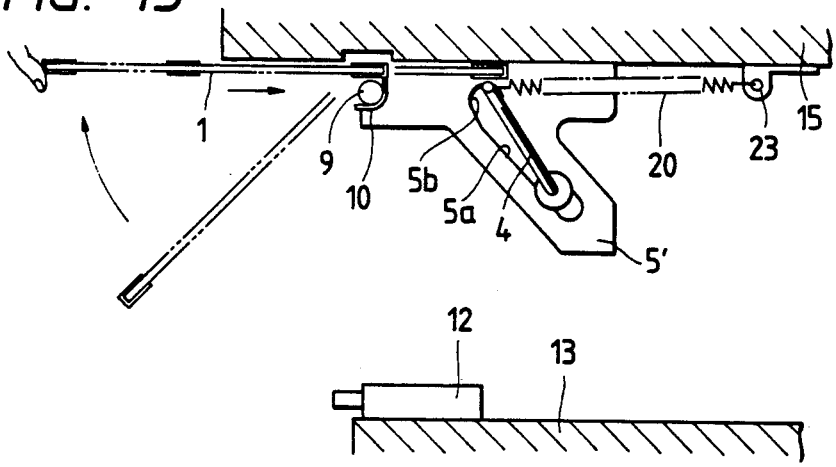

The second embodiment differs from the first embodiments mainly in that a tension spring 20 is provided for introducing the door 1 from its horizontal extended open position to its horizontal retracted open position. A spring retainer 21 as shown in FIG. 11 is fastened to the inner side of the edging member 2 by screws 22 and is disposed centrally of the length of the door 1. Another spring retainer 23 is fixedly secured to the lower surface of the upper plate 15 of the case body and disposed centrally of the width of the case body. The tension spring 20 extends between the two spring retainers 21 and 23. As shown in FIG. 9, unlike the slot 5*a* of the guide plate 5 of the first embodiment, a slot 5*a*′ of each of guide plates 5′ does not open to the rear end of the guide plate 5′. The upper or front end of the slot 5*a*′ is enlarged into a generally circular shape, and a rear arcuate portion 5*b* of this upper end remote from the door 1 serves as a lock means for lockingly holding the roller 8 in a stable manner when the door 1 is in its closed position so as to positively prevent the door 1 from being accidentally opened. As shown in FIGS. 9 and 10, a guide member 24 is fixedly mounted on each of the guide plates 5' in such a manner that an upper surface of the guide member 24 extends horizontally at the same level as the uppermost portion of the outer periphery of the roller 9. The pair of guide members 24 serve to guide the movement of the door 1 between its horizontal extended open position and horizontal retracted open position.

Figure 16:
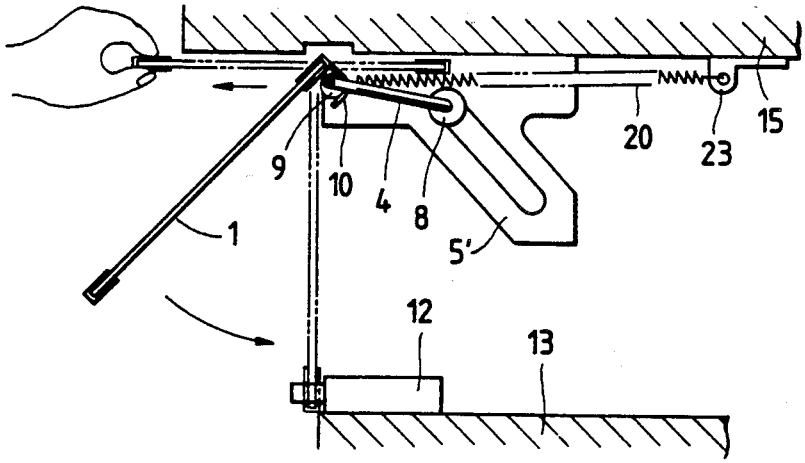

In this embodiment, after the door 1 is pivotally moved from its vertical closed position to its horizontal extended open position, the door 1 is automatically urged from its horizontal extended open position to horizontal retracted open position under the influence of the tension spring 20, thus facilitating the introduction of the door 1 into the case body. For closing the door 1, the door 1 is first fully withdrawn horizontally from its horizontal retracted open position as seen in FIG. 16, and then is slightly moved in the reverse direction, that is, pushed backward, so as to engage each of the rollers 8 in the arcuate lock portion 5*b* of the slot 5*a*' of a respective one of the guide plates 5' and 5'. Then, the door 1 is pivotally moved downwardly to its vertical closed position. In this condition, the roller 8 is held in the arcuate portion 5*b* of the slot 5*a*', so that the door 1 is positively held in its closed position against accidental opening movement which would be caused under the influence of the tension spring 20. For introducing the door 1 into the case body, the door 1 is first pivotally moved from its closed position to horizontal extended open position and then is slightly pulled outwardly to disengage each roller 8 from the arcuate portion 5*b* of the slot 5*a*' of the guide plate 5' to release the locking engagement therebetween. Then, the door 1 is allowed to be moved from its horizontal extended open position to horizontal retracted open position under the influence of the tension spring 20. During the time when the door 1 is moved into its horizontal retracted open position under the influence of the tension spring 20, the lateral movement prevention bar 4 prevents the lateral movement of the door 1 through the engagement of the rollers 4 and 4 in the respective slots 5*a*' of the guide plates 5, so that the door is smoothly introduced into the case body, as described above for the first embodiment. When the door 1 is moved into its horizontally retracted open position, each roller 8 is brought into engagement with the end edge of the closed rear or lower end of the slot 5*a*' to limit a further inward movement of the door 1. In this condition, the inwardly-disposed end portion of the horizontally-disposed door 1 where the edging member 2 is provided is supported by the lateral movement preventing bar 4.

As described above, the hinge members 10 can be moved into the case body together with the door 1, and therefore the opened door 1 can be received in the case body, so that the opened door will not be obstructive and does not detracts from the appearance of the case, as is the case with the prior art. In addition, the door will not be subjected to damage or breakage even where the door is made of a glass panel. Further, the door operating mechanisms according to the present invention are relatively simple in construction, which is desirable from the viewpoint of manufacture.

Still further, by virtue of the provision of the lateral movement preventing bar 4 carrying the rollers 8 as well as the guide plates 5 for guiding the movement of the rollers 8, the door 1 can be horizontally moved into and out of the case body in a stable and smooth manner without being displaced laterally of the case body.

While the invention has been described in detail and with reference to specific embodiments thereof, it will be apparent to one skilled in the art that various changes and modifications can be made therein without departing from the spirit and scope thereof.

What is claimed is:

1. A door operating mechanism for opening and closing a door with respect to a vertically-disposed opening of a case, said door adapted to move pivotally from a vertically closed position to a horizontally extended open position and horizontally from said horizontally extended open position to a horizontally retracted open position; said mechanism comprising:

2. A door operating mechanism according to claim 1, in which a pair of second rollers each having a peripheral groove are rotatably mounted on horizontally from said horizontally extended open position to a horizontally retracted open position; said mechanism comprising:

hinge means for selectively connecting an upper end of the door to the case in a hinged manner so as to guide said pivotal movement of the door between a said vertical closed position and said horizontally extended open position wherein the door is extended outwardly from the case;

means for guiding said horizontal movement of the door between said horizontal extended open position and said horizontal retracted open position where the door is received in the case;

a lateral movement preventing bar, said lateral movement preventing bar being defined by a main straight portion, a pair of opposed arm portions extending right-angularly respectively from opposite ends of said main straight portion, and a pair of end portions extending right-angularly respectively from one end of said opposed arm portions respectively remote from said main straight portion, said main straight portion being pivotally secured to the upper end of the door in such a manner that said lateral movement preventing bar is prevented from moving laterally of the door, said guiding means comprising a pair of opposed guide plates adapted to be fixedly mounted respectively on opposed said walls of the case and each having a slot, each of said end portions of said lateral movement preventing bar being engaged in a respective one of said slots so as to be moveable therealong in such a manner so that lateral displacement of said lateral movement preventing bar is prevented. said end portions of said lateral movement preventing bar, respectively, each of said second rollers being fitted in a respective one of said slots of said guide plates for movement therealong.

3. A door operating mechanism according to claim 1 or claim 2, in which there is provided a magnetic member adapted to be secured on the door, there being provided a magnetic catch mounted internally of the case, said magnetic catch magnetically attracting said magnetic member when the door is in its horizontal retracted open position, thereby holding the door against movement toward its horizontal extended open position.

4. A door operating mechanism according to claim 1 or 2, further comprising a tension spring adapted to be mounted internally of the case so as to urge the door from its horizontal extended open position to horizontal retracted open position.

5. A door operating mechanism according to claim 4, in which each of said guide plates has a closed front end disposed closer to the opening of the case and a closed rear end remote from the opening, said slot having a lock portion for releaseably holding a respective one of said end portions of said lateral movement preventing bar to lock the door in its closed position.

6. A door operating mechanism for opening and closing a door with respect to a vertically-disposed opening of a case, said door adapted to move pivotally from a vertically closed position to a horizontally extended open position and horizontally from said horizontally extended open position to a horizontally retracted open position; said mechanism comprising:

hinge means for selectively connecting an upper end of the door to the case in a hinged manner so as to guide said pivotal movement of the door between a said vertical closed position and said horizontally extended open position wherein the door is extended outwardly from the case, said hinge means comprising a hook-shaped hinge member fixedly mounted on the upper end of said door; and a roller rotatably mounted on the case, said hinge member being selectively engaged with an outer periphery of said roller so as to guide the pivotal movement of the door between its vertical closed position and horizontal extended open position, said hinge member being disengaged from said roller so as to be moved into the case when the door is moved from its horizontally extended open position toward its horizontally retracted open position, and said roller being rollingly engaged with the door during the movement of the door between its horizontal extended open position and its horizontal retracted open position;

means for guiding said horizontal movement of the door between said horizontal extended open position and said horizontal retracted open position where the door is received in the case; and a lateral movement preventing bar, said lateral movement preventing bar being defined by a main straight portion, a pair of opposed arm portions extending right-angularly respectively from opposite ends of said main straight portion, and a pair of end portions extending right-angularly respectively from one end of said opposed arm portions respectively remote from said main straight portion, said main straight portion being pivotally secured to the upper end of the door in such a manner that said lateral movement preventing bar is prevented from moving laterally of the door, said guiding means comprising a pair of opposed guide plates adapted to be fixedly mounted respectively on opposed side walls of the case and each having a slot, each of said end portions of said lateral movement preventing bar being engaged in a respective one of said slots so as to be movable therealong in such a manner so that lateral displacement of said lateral movement preventing bar is prevented.

7. A door operating mechanism according to claim 6 in which a pair of second rollers each having a peripheral groove are rotatably mounted on said end portions of said lateral movement preventing bar, respectively, each of said second rollers being fitted in a respective one of said slots of said guide plates for movement therealong.

8. A door operating mechanism according to claim 6 or claim 7, in which there is provided a magnetic member adapted to be secured on the door, there being provided a magnetic catch mounted internally of the case, said magnetic catch magnetically attracting said magnetic member when the door is in its horizontal retracted open position, thereby holding the door against movement toward its horizontal extended open position.

9. A door operating mechanism according to claim 6 or 7, further comprising a tension spring adapted to be mounted internally of the case so as to urge the door from its horizontal extended open position to horizontal retracted open position.

10. A door operating mechanism according to claim 9, in which each of said guide plates has a closed front end disposed closer to the opening of the case and a closed rear end remote from the opening, said slot having a lock portion for releaseably holding a respective one of said end portions of said lateral movement preventing bar to lock the door in its closed position.

* * * * *